US008800240B1

(12) United States Patent
Solis

(10) Patent No.: US 8,800,240 B1
(45) Date of Patent: Aug. 12, 2014

(54) RE-BARS SUPPORTS FOR CONCRETE OR CEMENT CONSTRUCTIONS

(71) Applicant: Samuel Rosario Solis, Patillas, PR (US)

(72) Inventor: Samuel Rosario Solis, Patillas, PR (US)

( * ) Notice: Subject to any disclaimer, the term of this patent is extended or adjusted under 35 U.S.C. 154(b) by 0 days.

(21) Appl. No.: 13/916,557

(22) Filed: Jun. 12, 2013

(51) Int. Cl.
*E04C 5/16* (2006.01)
*E04C 5/18* (2006.01)
*E04C 5/20* (2006.01)

(52) U.S. Cl.
CPC .... *E04C 5/18* (2013.01); *E04C 5/20* (2013.01)
USPC ..... 52/686; 52/633

(58) Field of Classification Search
USPC ..... 52/686, 633, 677, 682
See application file for complete search history.

(56) References Cited

U.S. PATENT DOCUMENTS 1,737,396 A * 11/1929 White ..... 52/685
3,255,565 A * 6/1966 Menzel ..... 52/678
3,788,025 A * 1/1974 Holmes ..... 52/685
5,107,654 A * 4/1992 Leonardis ..... 52/685
5,626,436 A * 5/1997 Dragone ..... 403/400
8,099,925 B1 * 1/2012 Coons ..... 52/686
8,322,108 B2 * 12/2012 Lee et al. ..... 52/677
2002/0112437 A1 * 8/2002 Queen ..... 52/677
2004/0031228 A1 * 2/2004 Hardy et al. ..... 52/687
2005/0102951 A1 * 5/2005 Bennett ..... 52/633
2011/0107719 A1 * 5/2011 Kodi ..... 52/745.21

* cited by examiner

*Primary Examiner* — Basil Katcheves
(74) *Attorney, Agent, or Firm* — Hector M. Reyes Rivera

(57) ABSTRACT

Supports having multiples apertures to receive, support, holding and secure re-bars or reinforcements useful in the construction of concrete or cement structures. A first embodiment includes two double rebar supporting sections at each end of a main elongated body having a central hole, thus it may support from two to four re-bars that may be have the same or different dimensions at its intercepting points. A second embodiment includes two double supporting re-bars supporting sections at each end of a main body. A third embodiment that includes a double supporting re-bars section in one end of a main body. The disclosed embodiments also have apertures and openings that allow the entrance of liquid cement or concrete mixture to the interior of their hollow main body and may support re-bars of different dimensions.

19 Claims, 8 Drawing Sheets

RE-BARS SUPPORTS FOR CONCRETE OR CEMENT CONSTRUCTIONS

CROSS REFERENCE TO RELATED APPLICATIONS

This application claims the benefit of U.S. Provisional Application No. 61/689,785, filed on Jun. 13, 2012 and claim the benefit of its earlier date under 35 USC section 119 (e).

TECHNICAL FIELD

This invention relates to reinforcement supports useful in supporting, holding and securing reinforcements or re-bars used in concrete or cement constructions. More particularly, the invention is directed to reinforcement or re-bars supports capable of simultaneously securing and fastening different types of reinforcements or re-bars as well as to maintain different type of re-bars mats in a stationary position order to facilitates the construction of concrete or cement structures of high strength and resistance.

BACKGROUND

Concrete structures are well known to require internal re-bars or reinforcement elements directed to increase tensile strength of the structure resulted. It is recognized in the construction industry that re-bars or reinforcement must be integrated at a predetermined depth or position inside the corresponding section of a given structure in order to maximize the strength and durability of the structure. Keeping the re-bars or reinforcement in a suitable and proper depth inside the structure would avoid the potential external exposure and oxidation of re-bars, which has been shown to be a detrimental to the stability of the structure: corrosion of reinforcement or re-bars promotes the weakening, deterioration and eventually the crumbling of cement and concrete structures. The reparation of damaged concrete or cement structures due to corrosion of re-bars results very expensive and time consuming task.

In order to maintain re-bars properly secure and in a stationary position during the construction of concrete structures re-bars must be organized in a grid or mat wherein the intersected re-bars are tied with wire, clips or similar structures. The obtained matt must also be kept at a proper depth inside the corresponding mold. However, during the construction process, it is extremely difficult to maintain the proper re-bar connectivity as a mat as well as to maintain the proper position of the mat inside the mold, particularly during the pouring of the cement or concrete mixture inside the mold.

BRIEF SUMMARY

The present invention discloses two a rebar supports highly versatile having a main hollow body, which are capable of receiving, supporting, holding and keeping in a stationary position at least two re-bars or reinforcement wherein the reinforcements may have the same or different dimensions in a single mat. Similarly, said re-bars supports may also be used in receiving, supporting, holding and maintaining in an stationary position a maximum of four re-bars of different or equal dimensions, thus being ideal for maintaining a predetermined distance between a double layers of re-bars of different predetermined dimensions. The supports may be also useful to raise a re-bars matts in order to avoid direct contact of the mats or re-bars with electrical or plumbing connections. In a yet third embodiment of the invention, an additional re-bar support having a suitable main body with multiple openings and lateral standing units perpendicularly connected is disclosed. It is highly convenient in receiving, supporting, and maintaining in a stationary position a re-bar matt and simultaneously raising said matt form a flat surface such as the surface of a floor or the surface of a mold, thus properly positioning re-bars in a matt at a predetermined position and simultaneously maintaining the mat in a predetermined position inside a mold or from the ground. All of the herein disclosed embodiment are easy to install, lightweight yet very strong and with apertures designed to facilitate the entrance of re-bar and the firm and stationary position of said re-bars inside the supports.

BRIEF DESCRIPTION OF THE DRAWINGS

The foregoing and additional features and characteristics of the embodiments of the present invention will become more apparent from the following detailed description considered with reference to the accompanying drawings, which are used herein in a manner of example only, and wherein.

DETAILED DESCRIPTION OF THE EMBODIMENTS

The following detailed description illustrates the invention by way of example and is not limited to the particular limitations presented herein as principles of the invention. This description is directed to enable one skilled in the art to make and use the invention by describing embodiments, adaptations, variations and alternatives of the invention. Potential variations of the limitations herein described are within the scope of the invention. Particularly, the size and shapes of the invention's elements illustrated in the discussion may be varied and still provide embodiments having different sizes or geometric shapes, that are within the scope of the instant invention.

The instant invention is directed to concrete or reinforcement supports, which are useful in receiving, supporting, holding, securing and spacing reinforcement elements such as re-bars during the construction of concrete or cement structures. In general terms, the herein described reinforcement supports are highly versatile and are designed to be used in fastening, securing and holding different reinforcement elements or re-bars in predetermined position, preferably previous to pouring concrete or cement mixture inside a construction mold or cast used to contain the liquefy cement or concrete mixture. In this manner different re-bars are kept in a desired configuration during and after the construction process and the rebar or reinforcement mat is also kept at a predetermined distance form the top and bottom of the mold. While the embodiments are herein described within the context of reinforcement elements such as re-bars, the described supports may be used in supporting and securing any other types of bars, conduits or elongated bodies, such as plumbing and electrical accessories.

The whole structures of reinforcement or re-bars supports described herein are made preferably of any hard, nonflexible and noncorrosive material. They may be preferably made of hard plastic made of certain polymers or metal and in an even more preferably embodiment, it is made of plastic made of polyoxymethylene (POM) and may be manufactured by molding according with the limitations described herein, which are explained in detailed below.

Figures 1A, 1B:
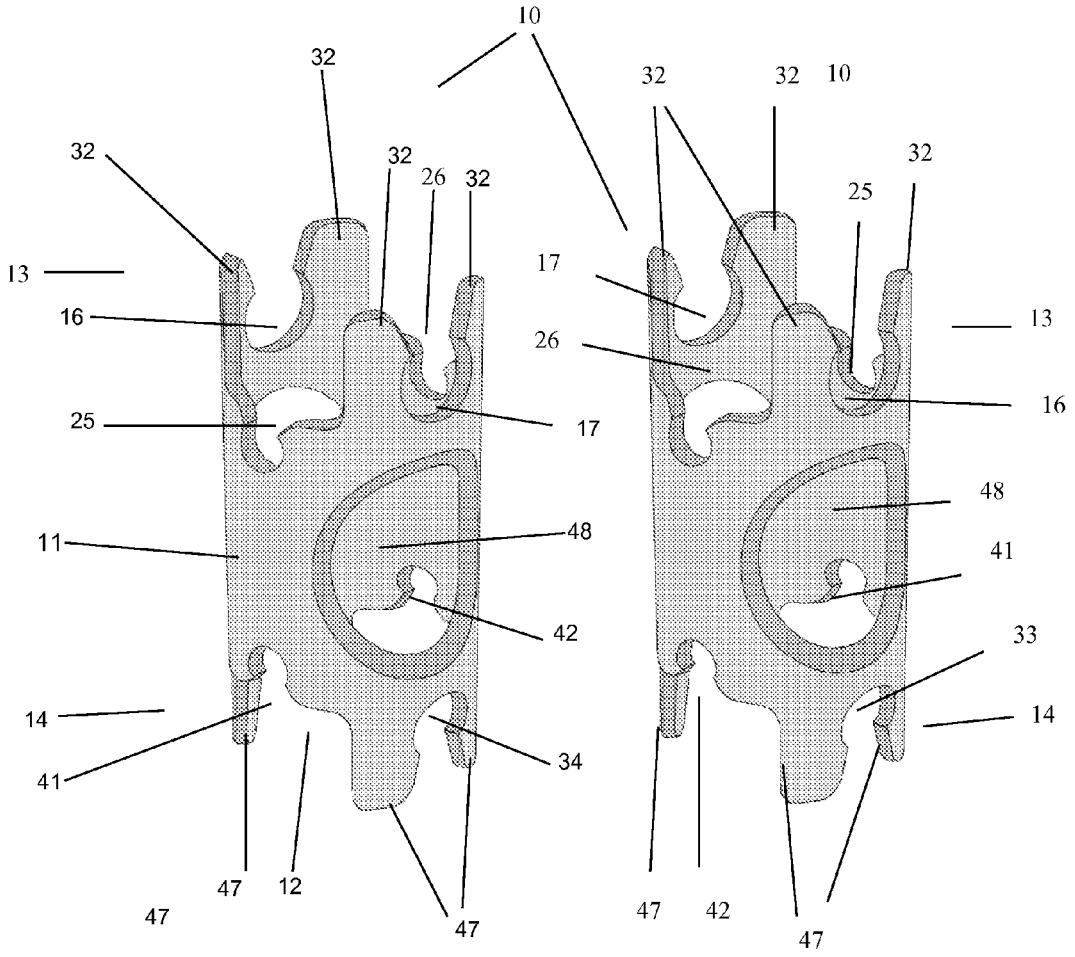
FIGS. 1A and 1B illustrate perspective views of one embodiment of the invention having four pair of supporting apertures and an elongated hollow main body.
Figure 2:
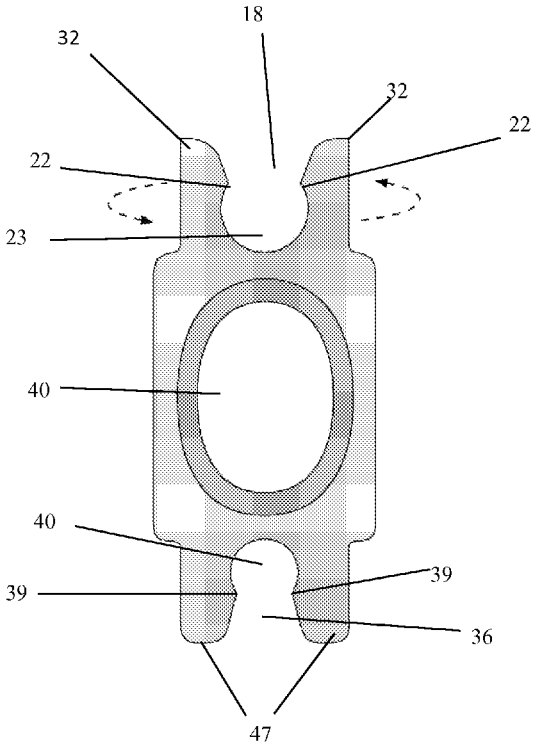
FIG. 2 represents a front view of the embodiment of the invention illustrated in FIGS. 1A and 1B.
Figure 3:
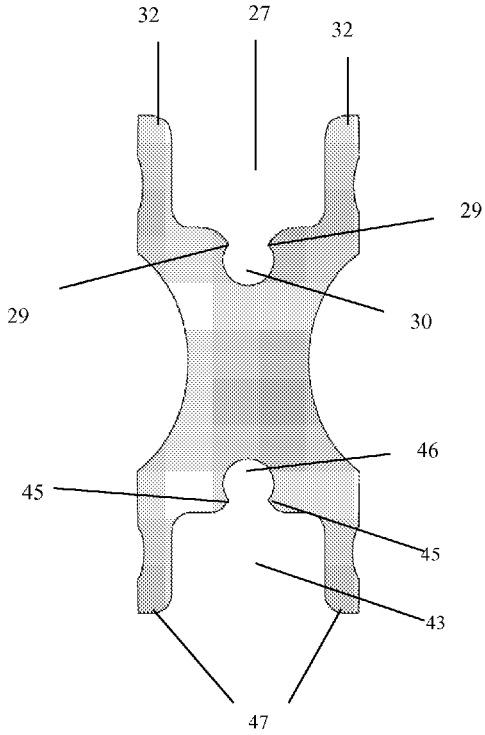
FIG. 3 illustrates a front view of the embodiment according to the invention illustrated in FIG. 2, after rotation by ninety (90) degrees.

In reference to the drawings, FIGS. 1A, 1B, 2 and 3 are diagrammatic representations of one embodiment according to the instant invention of reinforcement support 10. It comprises main elongated hollow body 11 having a hollow cavity 12, first upper end 13 and second lower end 14. It should be understood that main elongated body 11, while illustrated having a round shape may have any other alternative shapes, such as round or any other potential geometric shape and still being within the scope of the invention and it may have different length and width according to the scope of the instant invention. Similarly, the terms upper end and lower end in reference to numerals 13 and 14 are herein used only for the purpose of describing the invention, nonetheless such terms are totally relative, particularly in operational terms since the position of reinforcement support 10 may use in any suitable or convenient manner. Taking as a reference the extreme outer end of first upper end 13 as illustrated in FIGS. 1A and 1B, support 10 also comprises a first pair of apertures 16 and 17 at the proximal position of said point of reference, and both of said apertures are located in an aligned position one with respect to the other. Apertures 16 and 17 are substantially identical and each one of said apertures comprises an upper section 18, which is open to the exterior of said main elongated body 11. Upper section 18 has its edges outwardly oriented and outwardly angled, thus reducing the wide of said upper section until said edges form a pair of pointed ends 22. Aperture 16 and 17 also comprises a lower section 23, which has a semicircular shape. Similarly, at the distal end of the cited point of reference, support 10 also comprise a second pair of apertures 25 and 26, which are located in an aligned position one with respect to the other. Apertures 25 and 26 are substantially identical and are positioned in a perpendicular position in reference to apertures 16 and 17. Each aperture 25 and 26 comprises upper section 27 open to the exterior of said main elongated body 11, said upper section 27 having a U shaped geometry. The lower side of said U shaped geometry is interrupted forming a pair of pointed ends 29. The lower section 30 of apertures 25 and 26 has a semicircular shape. The external section of first end 13 also comprises a set of four legs 32, which are formed as direct consequence of the contour or outline of the first pair of apertures 16 and 17 and the second pair of apertures 25 and 26.

Similarly, second end 14 of main elongated and hollow body 11 comprises a third pair of apertures 33 and 34, located in an aligned position one with respect to the other at a proximal position of the extreme outer point of said second end 14. Both apertures 33 and 34 are substantially identical and each one of said apertures 33 and 34 comprises lower section 36, which is open to the exterior of said main elongated body 11, said lower section 36 having its edges outwardly oriented and outwardly angled, thus reducing the wide of said lower section 36 until said edges form a pair of pointed ends 39. Apertures 33 and 34 also have upper section 40, which has a semicircular shape.

At the distal position in reference to said second end 14, support 10 also comprises a fourth pair of apertures 41 and 42, which are located in an aligned position one with respect to the other. Apertures 41 and 42 are substantially identical in shape and dimensions and are positioned perpendicularly in reference to said third pair of apertures 33 and 34. Each one of said apertures 33 and 34 comprises an inverted U shaped lower section 43, which is open to the exterior of second end 14 of main elongated body 11 and wherein the lower side of said inverted U shaped geometry of lower section 43 is interrupted forming a pair of pointed ends 45. The upper section 46, of apertures 33 and 34 has a semicircular shape. Support 10 also comprises a set of four legs 47, which are formed as direct consequence of the contour or outline of the third pair of apertures 33 and 34 and the fourth pair of apertures 41 and 42. Thus, the first pair of apertures 16 and 17 is in a parallel position with respect to the third pair of apertures 33 and 34, while the second pair of apertures 25 and 26 is in a parallel position to the fourth pair of apertures 41 and 42. Similarly, each one of the legs 32 at the first end 13 is perpendicular positioned to another leg 47 at the second end 14. Support 10 also comprises hole 48 at the center or substantially the center of the main hollow elongated body 11. Said hole 48 being parallel positioned with respect to first pair of apertures 16 and 17 and to the third pair of apertures 33 and 34. The dimensions of first pair of apertures 16 and 17, second pair of apertures 33 and 34, third pair of apertures 25 and 26 and forth pair of apertures 41 and 42 may be identical or different. The instant invention embraces all potential variations of dimensions for the four pair of apertures previously described. For instance, all pairs of apertures may have the same dimensions, or all pair of apertures may have different dimensions. Similarly, the first and third pair of apertures may have the same dimensions while the second and fourth pair of apertures may have the same dimensions, wherein the dimensions of the first and third pairs of apertures are larger than the dimensions of the second and fourth pair of apertures. Alternatively, the first and third pair of apertures may have the same dimensions while the second and fourth pair of apertures may have the same dimensions, wherein the dimensions of the first and third pairs of apertures are smaller than the dimensions of the second and fourth pair of apertures. The variability in such dimensions is highly convenient due to the fact that each pair of apertures conform a rebar resting section as explained below, thus the dimensions of the apertures described in support 10 are relative to the dimensions of the re-bars required for a particular construction need. Thus, the dimension of the corresponding pair of apertures corresponds to the dimensions of the re-bars being supported by said pair of apertures as may be required in a particular construction task. In this manner, a variety of types of support 10 may be used to support a maximum number of 4 re-bars of the same or different combination of dimensions, depending of the nature or need in a given structure being constructed, as indeed is demanding by different construction codes.

Figure 4:
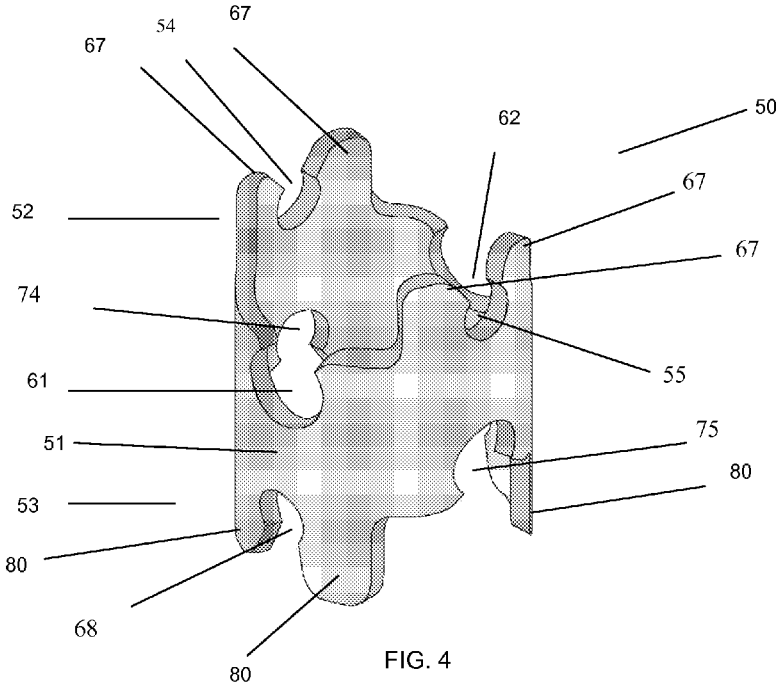
FIG. 4 shows a perspective view of a second embodiment according to the invention.
Figure 5:
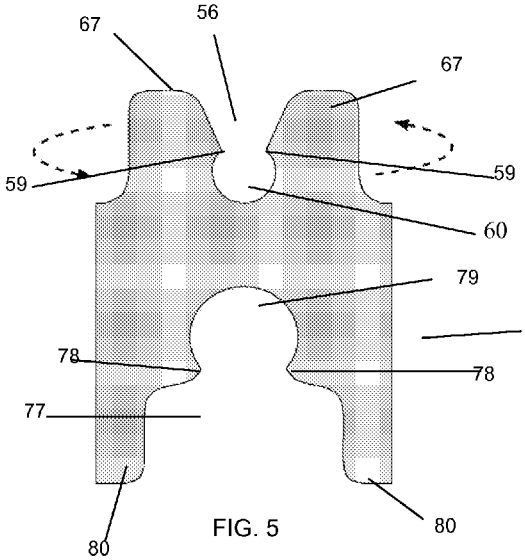
FIG. 5 illustrates a front view of the second embodiment according to the invention illustrated in FIG. 4.
Figure 6:
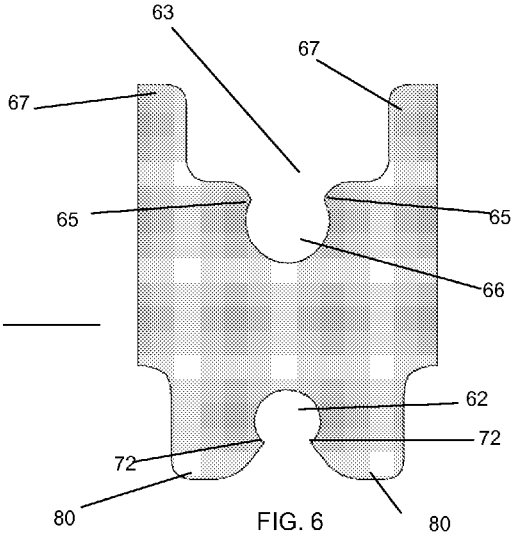
FIG. 6 shows a front view of the embodiment illustrated in FIG. 5, after a rotation of ninety (90) degrees.

In reference to the drawings, FIGS. 4, 5 and 6 are diagrammatic representations of reinforcement support 50, a second embodiment according to the invention. It comprises a main hollow body 51 having first top end 52 and second lower end 53. Regardless of the fact that the main body 51 is shown having a round shape, it may have any other potential shape according to the scope of the instant invention. The terms top and lower positions being designated herein for purpose of describing support 50, but being relative in the operational terms of support 50. It should be understood that the width and length of main body 51 may be variable depending of a particular construction need. Support 50 also comprises a first pair of apertures 54 and 55, located in an aligned position one with respect to the other at a proximal section of said first top end 52, both of each apertures 54 and 55 being identical in shape and dimensions. Apertures 54 and 55 comprise upper section 56, which is open to the exterior at the top side of said main body 51. Said upper section 56 has its edges outwardly oriented and outwardly angled, thus reducing the wide of said upper section until forming a pair of pointed ends 59. The lower section 60 of apertures 54 and 55 has a semicircular shape.

At a distal position of first end 52, it also comprises a second pair of apertures 61 and 62, located in an aligned position one with respect to the other and both of each aperture 61 and 62 being identical in shapes and dimensions. Said apertures 61 and 62 are perpendicularly positioned in reference to the first pair of apertures 54 and 55. Apertures 61 and 62 comprise an upper section 63, having a U shaped geometry, which is open to the exterior at the top of said main body; wherein the lower side of said U shaped geometry of section 63 is interrupted forming a pair of pointed ends 65. The lower section 66 of apertures 61 and 63 has a semicircular shape. Reinforcement support 50 also comprises a set of four legs 67, which are formed as direct consequence of the contour or outline of the first pair of apertures 54 and 55 and the second pair of apertures 61 and 62.

Support 50 at its proximal position of the second end 53 also comprises a third pair of apertures 68 and 69, which are located in an aligned position one with respect to the other, both of each apertures 68 and 69 having identical shapes and dimensions and having lower section 70, which is open to the outer extreme of said main body at the lower second end 53, said lower section 70 having its edges outwardly oriented and outwardly angled, thus reducing the wide of said lower section 70 and forming a pair of pointed ends 72. The upper section 62 of lower section 70 has a semicircular shape. Reinforcement support 50 also comprises a fourth pair of apertures 74 and 75, located in an aligned position one with respect to the other at a distal position of said second lower end 53, both of each apertures 74 and 75 having identical shapes and dimensions and being positioned perpendicularly in reference to said third pair of apertures 68 and 69. Apertures 74 and 75 comprise two main sections: lower section 77, which is open to the exterior of said main body 51 at the lower second end 53, said lower section 77 having an inverted U shaped geometry interrupted by forming a pair of pointed ends 78. The upper section 79 of apertures 74 and 75 has a semicircular shape. Reinforcement support 50 also comprises a set of four legs 80, which are formed as direct consequence of the contour or outline of the third pair of apertures 68 and 69 and the fourth pair of apertures 74 and 75. The first pair of apertures 54 and 55 is in a parallel position to the fourth pair of apertures 74 and 75 while the second pair of apertures 61 and 62 is in a parallel position to the third pair of apertures 68 and 69. The relative dimensions of each pair of apertures depend on the relative size of the rebar intended to be supported by said pair of apertures, as explained below.

Reinforcement supports 10 and 50 are highly versatile since it may be used in placing, fastening, securing, holding, supporting and spacing multiple reinforcement elements simultaneously in the construction process on a variety of situations. In this manner, its use eliminates the need of ties or caps in wiring the reinforcement or re-bars in mats used in construction. Their strength exceeds the standard requirements of the International Code Council (ICC) the Uniform Building Code (UBC) the American Concrete Institute, the American Association of State Highway and the Concrete Reinforcing Steel Institute. The mentioned codes required a load resistance of 250 to 300 pounds and a critical load in axial compression of 320 pounds. The herein described supports are in fully compliance with such requirements since are able to support said required loads.

Figure 10:
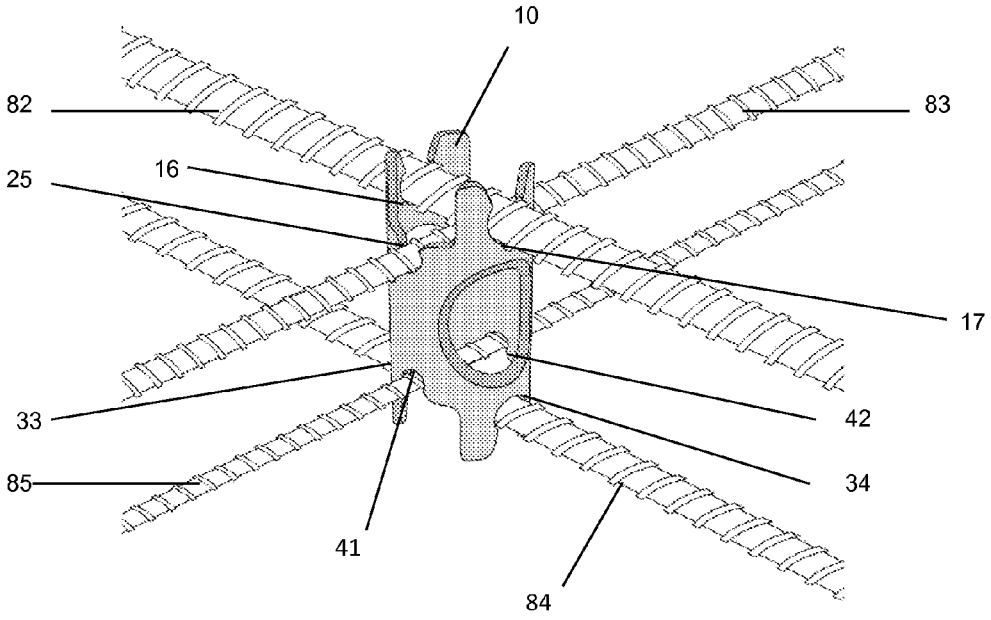
FIG. 10 illustrates a perspective view of the first embodiment according to the invention, wherein a total of four transversal re-bars are being supported and held and wherein larger diameter re-bars are positioned in a parallel position and smaller diameter re-bars are in a parallel position and in perpendicular position with regards to the larger diameter re-bars.

In operative terms, one preferable use of support 10 is illustrated in FIG. 10, showing a partial section of a double reinforcement mat wherein the support 10 is use to firmly hold, fast, support and space four reinforcement bars simultaneously. As illustrated in FIG. 10, at the top of support 10 apertures 16 and 17 provide a first rebar resting section wherein the reinforcement or rebar 82 is maintain in an stationary position; apertures 25 and 26 conform a second rebar resting section wherein reinforcement or rebar 83 is stationary kept. At the lower section of support 10, apertures 33 and 34 provide a third rebar or reinforcement space for rebar 84 and apertures 41 and 42 provide the forth rebar or reinforcement section for rebar 85. The particular shape of the all apertures of support 10 have been designed to facilitate the entrance of re-bars or reinforcement to the particular re-bar resting section that such apertures define while inducing the re-bar or reinforcement to stay inside the particular apertures of re-bar support 10. Similarly, the centered hole 18, open ends 13 and 14 as well as hollow cavity 12 allow the entrance of the concrete or cement mixture into the interior of the support 10. The use of support 10, as illustrated in FIG. 10, is highly convenient since it simultaneously (1) allows maintaining a predetermined distance between the different types of re-bars or reinforcement 82 and 83 used at the upper section of the mat; (2) allows maintaining a predetermined distance between the re-bars or reinforcement 84 and 85 at the lower section of the mat; (3) allows to maintain a predetermined between the set re-bars or reinforcement 82 and 83 at the upper section and set of re-bars or reinforcements 84 and 85 located at the lower section of the mat and (5) allows to maintain a predetermined distance of the whole set of reinforcements or re-bars with reference to the top and bottom section of the mold enclosing the whole mat. As a consequence, by selecting the proper dimensions of reinforcement support 10, any of said predetermined distances may be adjusted to the requirements of any construction code and any combination of re-bars having different diameters may be stationary supported held and kept stationary in a simultaneous manner. Similarly, the sizes of the apertures in support 50 may be identical or different in dimensions, thus allowing the use and support of any given combinations of re-bars having the same or different diameters. Furthermore, the resultant structure built using this support 10 has excellent strength due to the fact that the reinforcement mat is properly located inside the concrete structure, condition that is essential in order to provide a structure able to support extreme temperature and pressure conditions.

Figure 12:
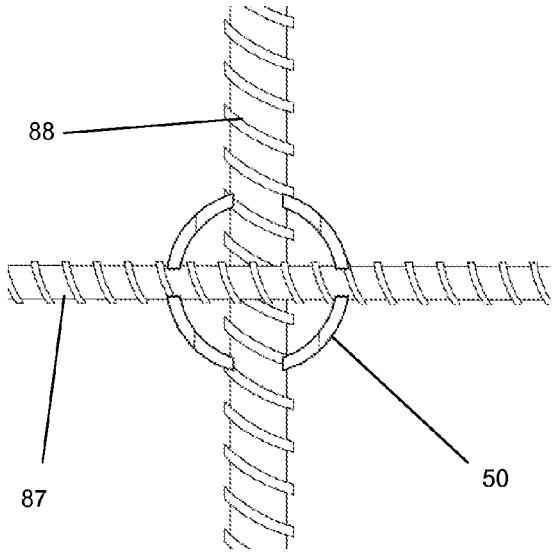
FIG. 12 illustrates a top view of the first embodiment of the invention already supporting two re-bars of different sizes.
Figure 11:
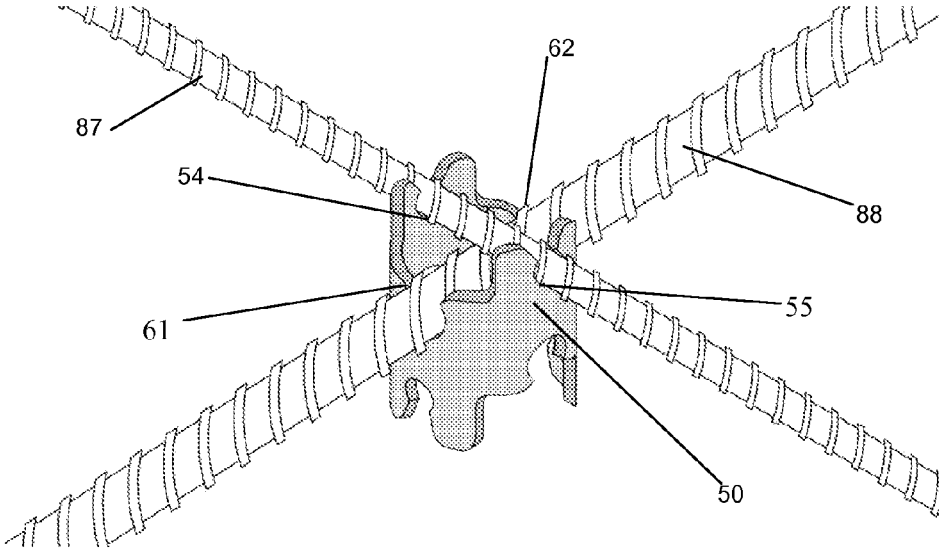
FIG. 11 illustrates a perspective view of the second embodiment of the invention already in use, wherein two re-bars in a transversal position and having different diameters are being supported and held.
Figure 13:
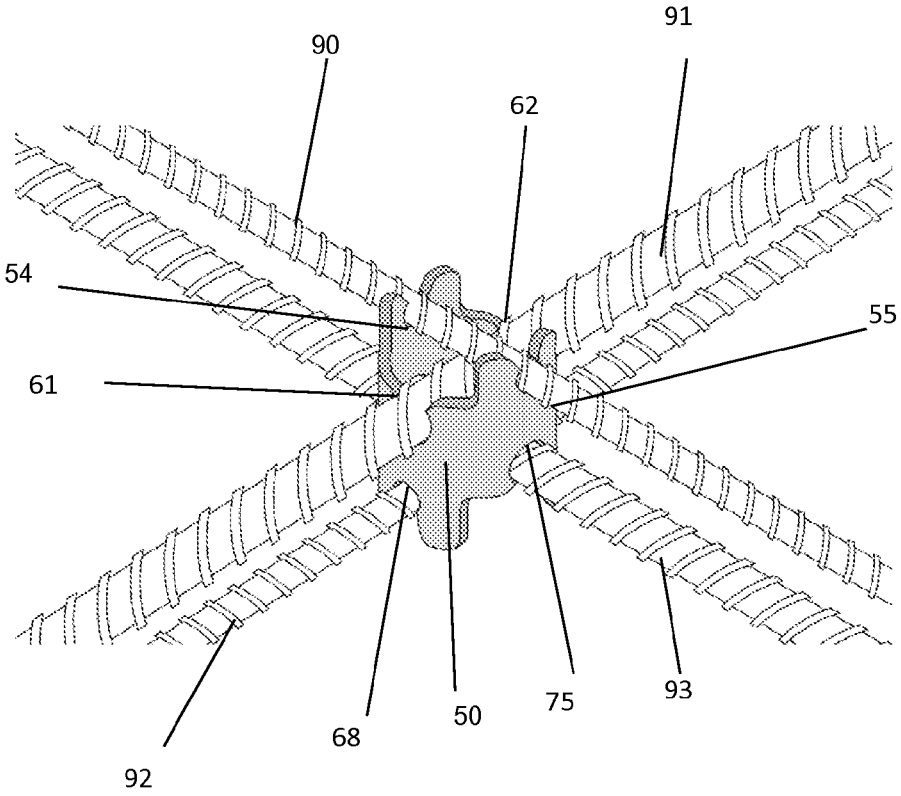
FIG. 13 illustrates a perspective view of the second embodiment according to the invention, already installed in a partially illustrated mat, wherein a total of four transversal re-bars are being supported and held and wherein larger diameter re-bars are perpendicularly positioned as well as smaller diameter re-bars.
Figure 14:
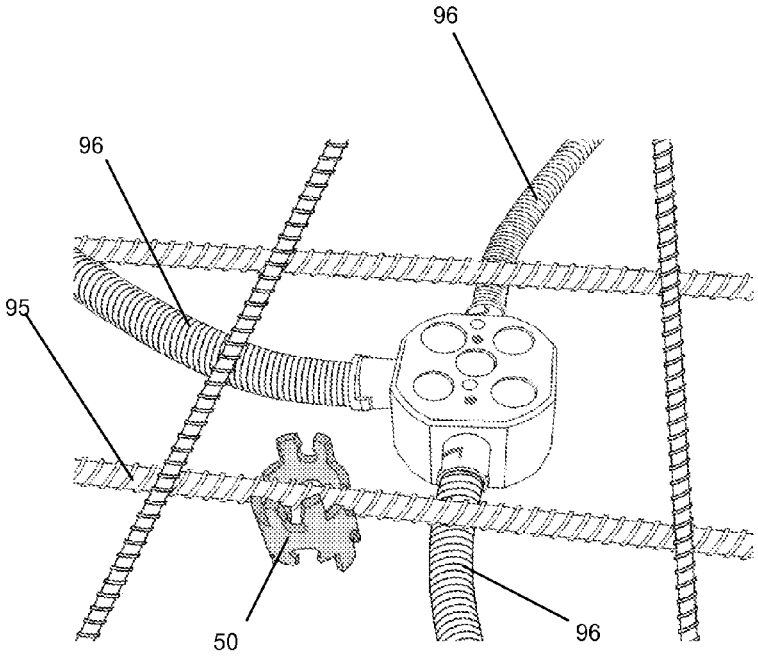
FIG. 14 illustrates a further use of the second embodiment according to the invention, wherein re-bar near electrical accessories are supported and held in order to avoid contract with said electrical accessories.

In a similar manner, FIGS. 11 and 12 diagrammatically illustrate the use of support 50 in a partial section of a single mat. As illustrated in FIG. 11, apertures 54 and 55 provide the rebar resting section wherein rebar or reinforcement 87 is stationary held and supported and apertures 61 and 62 provide rebar or reinforcement resting section for rebar or reinforcement 88. Reinforcement support 50 allows that the predetermined distance between re-bars 87 and 88 to be kept in a stationary manner and to maintain a predetermined distance of said re-bars from the top and bottom section of the construction mold (not illustrated). FIG. 12 represents a diagrammatical representation of the top view of the already installed support 50 in FIG. 11. By alternating the dimensions of the apertures on support 50 to the ones illustrated in FIG. 11, the position of re-bars is alternated, which is highly convenient and adaptable to multiple construction needs. Similarly, FIG. 13 represents a partial section of the already installed support 50, wherein two pairs of different sizes of re-bars are used to create a double mat of re-bars or reinforcement. As illustrated in FIG. 13, at the top section of support 50, apertures 54 and 55 provide the rebar resting section wherein rebar or reinforcement 90 is stationary held and supported and apertures 61 and 62 provide rebar or reinforcement resting section for rebar or reinforcement 91. At the lower section of support 50, apertures 68 and 69 provide the rebar resting section for rebar or reinforcement 92 while apertures 74 and 75 constitute the rebar resting section accommodating re-bar or reinforcement 93. The particular shape of the all apertures of support 50 have been designed to facilitate the entrance of re-bars or reinforcement to the particular re-bar resting section that such apertures define while inducing the re-bar or reinforcement to stay inside the re-bar support.

Similarly, the open ends 52, 53 and the hollow cavity 51 of the support 50 allow the entrance of the concrete or cement mixture into the interior of said support. In this manner, using of support 50, as illustrated in FIG. 13: (1) the predetermined distance between the different types of re-bars or reinforcement 90 and 91 at the upper section of the reinforcement mat is maintained in a fix position; (2) the predetermined distance between the re-bars or reinforcement 92 and 93 at the lower section of the mat is maintained (3) allows to maintain a predetermined between the set re-bars or reinforcement 90 and 91 at the upper section and set of re-bars or reinforcements 92 and 93, located at the lower section of the mat and (5) allows to maintain a predetermined distance of the whole set of reinforcements or re-bars with reference to the top and bottom section of the mold enclosing the whole mat.

As in the case of reinforcement support 10, by selecting the proper dimensions (width and length) of reinforcement support 50, any of said predetermined distances may be adjusted to the requirements of any construction code and any combination of re-bars having different diameters may be stationary supported held and kept stationary in a simultaneous manner. Similarly, by selecting the proper dimension of a given pair of apertures, re-bars of different diameters may be supported using support 50. Furthermore, the resultant structure built using this support 50 has excellent strength due to the fact that the reinforcement mat is properly located inside the concrete structure, condition that is essential in order to provide a structure able to support extreme temperature and pressure conditions.

Figure 15:
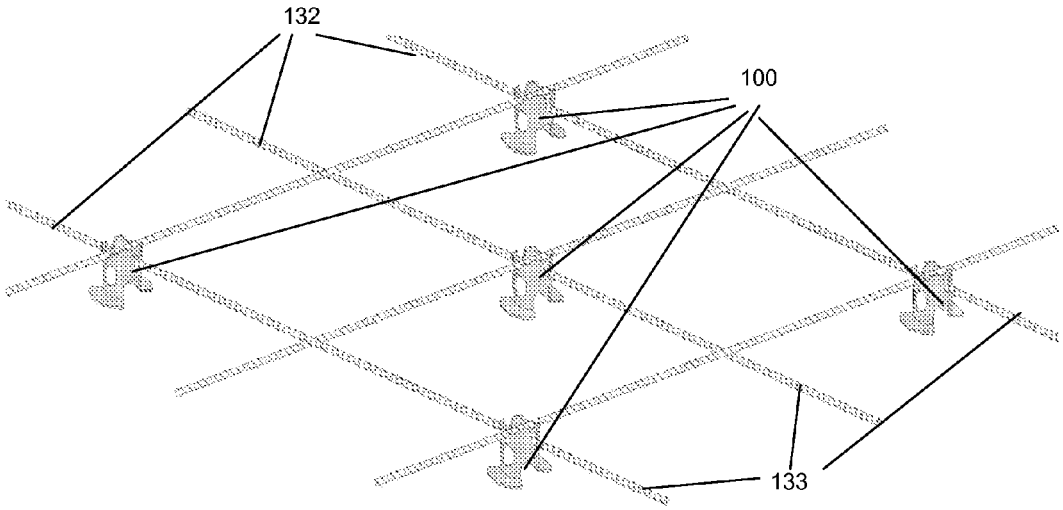
FIG. 15 illustrates one of the used of the third embodiment supporting and holding a re-bars matt in order to properly position said re-bars matt at a convenient position previous to the pouring of liquid cement or concrete mixture.

An alternative use of support 50 is illustrated in FIG. 15, wherein support 50 use to raise up rebar or reinforcement 95 in order to avoid electrical accessories 96 inside a construction mold (not illustrated) to be in direct contact with the reinforcement mat.

Figure 7:
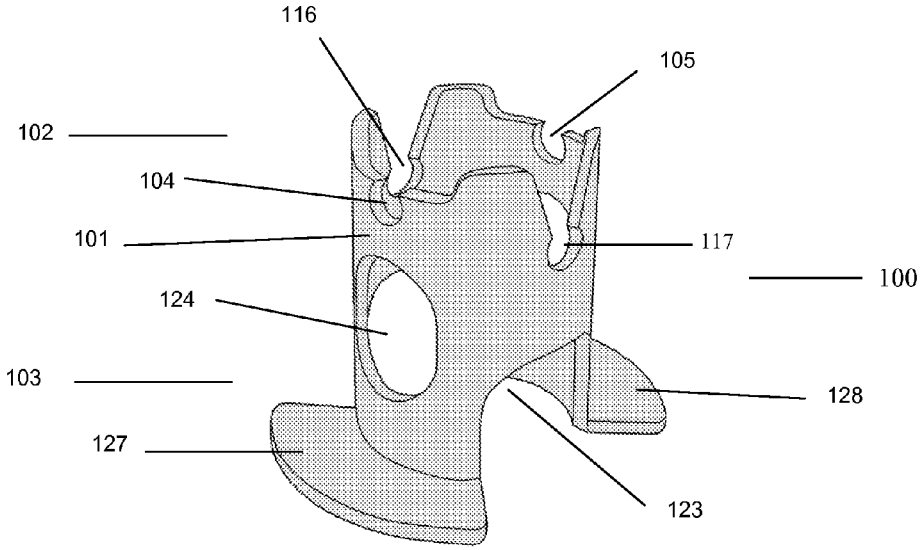
FIG. 7 illustrates a perspective view of a third embodiment according to the invention, having lateral standing units.
Figure 8:
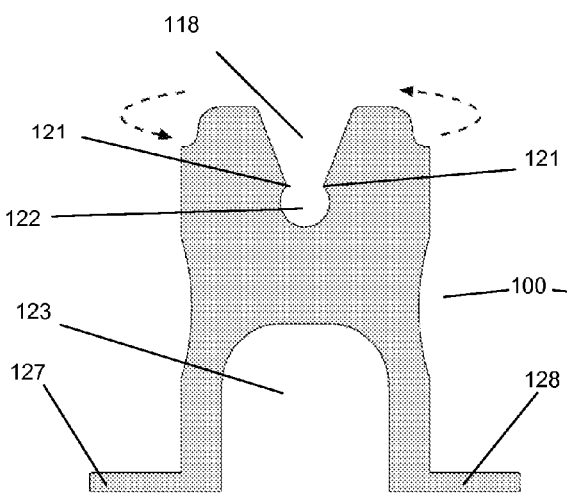
FIG. 8 shows a front view of the third embodiment according to the invention and previously illustrated in FIG. 7.
Figure 9:
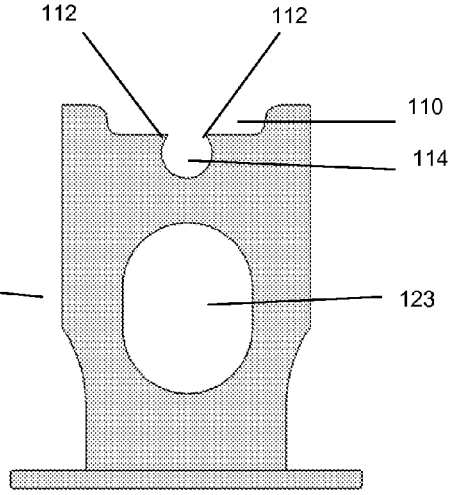
FIG. 9 shows a front view of the third embodiment according to the invention and previously illustrated in FIG. 9, after a ninety degrees rotation.

A third embodiment according to the instant invention, reinforcement support 100 is diagrammatic represented in FIGS. 7, 8 and 9. It comprises main elongated hollow body 101, having first top end 102 and second lower end 103. At the proximal end of said first top end 102, it also comprises a first pair of apertures 104 and 105, located in an aligned position one with respect to the other. Apertures 104 and 105 are substantially identical in shapes and dimensions. Each of said apertures 104 and 105 comprises two main sections: upper section 110, which is open the exterior of said main elongated body 101 at the top first end 102 and has a U shaped geometry, wherein the lower side of said U shaped geometry is interrupted forming a pair of pointed ends 112. Lower section 114 of apertures 104 and 105 has a semicircular shape. Reinforcement support 100 also comprises a second pair of apertures 116 and 117, located in an aligned position one with respect to the other at a distal position of said first top end 102, both of each aperture 116 and 117 having identical shape and geometry. Apertures 116 and 117 comprise two main sections: upper section 118 open to the exterior of said main elongated body 101 at the top end 102, having its edges outwardly oriented and outwardly angled, thus reducing the width of said upper section and forming a pair of pointed ends 121 and lower section 122 having a semicircular shape. First pair of apertures 104 and 105 is perpendicularly positioned in reference to second pair of apertures 116 and 117.

At the lower end 103 support 100 also comprises an inverted U shape opening 123, located in an aligned position with respect to apertures 104 and 105 and passing through lateral section of the main body 101. Support 100 also comprises hole 124 located substantially at and passing through the center of elongated hollow main body 101, which is located in a parallel position with reference to first pair of apertures 104 and 105. In a parallel position to said hole 124, support 100 comprises a pair of aligned and identical lateral extended standing units 127 and 128, which are located perpendicularly to the extreme of said second lower end.

In operational terms, support 100 is highly convenient in raising a mat from a flat surface, such as a floor or the internal surface of a mold. FIG. 15, illustrated the used of support 100 in raising a floor reinforcement or rebar mat 130. As illustrated, apertures 104 and 105 conforms a rebar resting section for re-bars 132 while apertures 116 and 117 provide the re-bar resting section for re-bars or reinforcement 133. Support 100 may be installed in all or some of the re-bars intersections, thus allowing the whole mat to be in a stationary predetermined position and maintaining a permanent predetermined distance from the flat surface. Similarly, support 100 also allows maintaining a predetermined distance between re-bars or reinforcements 132 and 133. Lateral extended standing units 127 and 128 provide an excellent stability of the mat, thus allowing it to support the weight of the concrete mixture before, during and after the pouring of cement or concrete mixture. Opening 123 and hole 124 in support 100 allows the concrete or cement mixture to enter to the hollow interior section of support 100. Reinforcement support 100 may be manufactured having different dimensions (width and length) wherein each pair of apertures may have identical or different dimensions, in a manner that it may be used in the permanent support or holding of re-bars or combination of re-bars or reinforcements of different sizes and/or diameters, according to the particular construction need.

While the invention has been described in conjunction with some embodiments, it is to be understood that many alternatives, modifications, and variations will be apparent to those skilled in the art in light of the forgoing description. Accordingly, the invention is intended to embrace all such alternatives, modifications and variations falling within the spirit and scope of the appended claims.

What is claimed is:

1. A re-bar support useful in the construction of concrete structures, said re-bar support comprising:

a main elongated hollow body;

a first upper end;

a second lower end;

a first pair of apertures, located in an aligned position one with respect to the other at a proximal section of said first end, both of each apertures being substantially identical and each of said apertures comprising:

an upper section open to the exterior of said main elongated body, said upper section having edges outwardly oriented and outwardly angled forming a pair of pointed ends and;

a lower section having a semicircular shape;

a second pair of apertures, located in an aligned position one with respect to the other at a distal section of said first upper end, both of each apertures of said second pair of apertures being substantially identical and perpendicularly positioned in reference to both apertures of said first pair of apertures; each of said second pair of apertures comprising:

an upper section open to the exterior of said main elongated body, said upper section having a U shaped geometry wherein the lower side of said U shaped geometry is interrupted forming a pair of pointed ends;

a lower section having a semicircular shape;

a set of four legs; formed by the contour of the first pair of apertures and the second pair of apertures;

a third pair of apertures, located in an aligned position one with respect to the other at a proximal position of said second lower end, both of each apertures being substantially identical and each of said apertures comprising:

an lower section open to the exterior of said main elongated body, said lower section having edges outwardly oriented, wherein the edges of said aperture are outwardly angled forming a pair of pointed ends and;

an upper section having a semicircular shape;

a fourth pair of apertures, located in an aligned position one with respect to the other at a distal position of said second lower end, both of each apertures being substantially identical and being positioned perpendicularly in reference to said third pair of apertures; each one of said fourth pair of apertures comprising:

an lower section open to the exterior of said main elongated body, said upper section having an inverted U shaped geometry, wherein the top side of said inverted U shaped geometry is interrupted forming a pair of pointed ends and;

an upper section having a semicircular shape;

a set of four legs which are formed by the contour of the third pair of apertures and the fourth pair of apertures;

a hole located substantially at and passing through the center of said elongated hollow main body and;

wherein the first pair of aperture is in a parallel position to the third pair of apertures; the second pair of aperture is in a parallel position to the fourth pair of apertures, each one of the legs at the first end is perpendicular positioned to another leg at the at the second end.

2. The re-bar support as recited in claim 1, wherein the hole at substantially the center of the main elongated body is positioned in a parallel position with respect to the first pair of apertures and the third pair of apertures.

3. The re-bar support as recited in claim 1, wherein the dimension of the first pair of aperture and the dimension of the third pair of apertures are substantially the same.

4. The re-bar support as recited in claim 1, wherein the dimension of the first pair of aperture and the dimension of the third pair of apertures are different.

5. The re-bar support as recited in claim 1, wherein the main elongated body is made of a hard, non-flexible material.

6. The re-bar support as recited in claim 1, wherein the main elongated body is made of plastic or metal.

7. The re-bar support as recited in claim 1, wherein the main elongated body is made of plastic.

8. A re-bar support useful in the construction of concrete structures, said re-bar support comprising:

a main hollow body;

a first end;

a second end;

a first pair of apertures, located in an aligned position one with respect to the other at a proximal position of said first end, both of each apertures being substantially identical and each of said apertures comprising:

an upper section open to the exterior of said main elongated body, said upper section having edges outwardly oriented wherein the edges of said aperture are outwardly angled forming a pair of pointed ends and;

a lower section having a semicircular shape;

a second pair of apertures, located in an aligned position one with respect to the other at a distal position of said first end and positioned perpendicularly in reference to said first pair of apertures, said second pair of apertures being substantially identical and each of said second pair of apertures comprising:

an upper section open to the exterior of said main elongated body, said upper section having a U shaped geometry; wherein the lower side of said U shaped geometry is interrupted forming a pair of pointed ends and;

a lower section having a semicircular shape, a set of four legs which are formed by the contour of the first pair of apertures and the second pair of apertures;

a third pair of apertures, located in an aligned position one with respect to the other at a proximal position of said second end, both of each apertures being substantially identical and each of said apertures comprising:

an lower section open to the exterior of said main elongated body, said upper section having edges outwardly oriented; wherein the edges of said aperture are outwardly angled forming a pair of pointed ends and;

an upper section having a semicircular shape;

a fourth pair of apertures, located in an aligned position one with respect to the other at a distal position of said second end, said fourth pair or apertures perpendicularly positioned in reference to said third pair of apertures; both of each apertures being substantially identical and each of said apertures comprising:

an lower section open to the exterior of said main elongated body, said upper section having an inverted U shaped geometry; wherein the upper side of said U shaped geometry is interrupted forming a pair of pointed ends and;

an upper section having a semicircular shape;

a set of four legs which are formed by the contour of the third pair of apertures and the fourth pair of apertures and;

wherein the first pair of aperture is in a parallel position to the forth pair of aperture and the second pair of aperture is in a parallel position to the third pair of apertures.

9. The re-bar support as recited in claim 8, wherein the sizes of the first pair of aperture and the third pair of apertures are substantially the same.

10. The re-bar support as recited in claim 8, wherein the sizes of the first pair of aperture and the second pair of apertures are different.

11. The re-bar support as recited in claim 8, wherein the main elongated body is made of a hard material.

12. The re-bar support as recited in claim 8, wherein the main elongated body is made of plastic or metal.

13. The re-bar support as recited in claim 12, wherein the main elongated body is made of plastic.

14. A re-bar support useful in the construction of concrete structures, said re-bar support comprising:

a main elongated hollow body;

a first upper end;

a second lower end;

a first pair of apertures, located in an aligned position one with respect to the other at a proximal position of said first end, both of each apertures being substantially identical and each of said apertures comprising:

an upper section open to the exterior of said main elongated body, said upper section having a U shaped geometry; wherein the lower side of said U shaped geometry is interrupted forming a pair of pointed ends and;

a lower section having a semicircular shape;

a second pair of apertures, located in an aligned position one with respect to the other at a distal position of said first end, wherein both apertures comprising said second pair of openings are perpendicularly positioned in reference to said first pair of apertures and each one of the said second pair of apertures are substantially identical and each of said apertures comprising:

an upper section open to the exterior of said main elongated body, said upper section having edges outwardly oriented; wherein the edges of said aperture are outwardly angled forming a pair of pointed ends and;

a lower section having a semicircular shape, an opening, passing through the main elongated hollow body, located at said second lower end, having an inverted U shaped geometry and in a parallel position with respect to the second pair of apertures;

a centered hole located substantially at and passing through the center of said elongated hollow main body, a pair of aligned and identical lateral extended standing units, located perpendicularly to the extreme of said second end and;

wherein each one of the apertures of the first pair of apertures, the centered hole and each one of the lateral extended support units are in a parallel position.

15. The re-bar support as recited in claim 14, wherein the dimension of the first pair of aperture and the dimensions of the second pair of apertures are substantially the same.

16. The re-bar support as recited in claim 14, wherein the dimension of the first pair of apertures and the dimension of the second pair of apertures are different.

17. The re-bar support as recited in claim 14, wherein the main elongated body is made of a hard material.

18. The re-bar support as recited in claim 14, wherein the main elongated body is made of plastic or metal.

19. The re-bar support as recited in claim 18, wherein the main elongated body is made of plastic.

* * * * *